US006639969B2

(12) United States Patent
Ochiai et al.

(10) Patent No.: US 6,639,969 B2
(45) Date of Patent: Oct. 28, 2003

(54) OPEN TYPE X-RAY GENERATING APPARATUS

(75) Inventors: Yutaka Ochiai, Hamamatsu (JP); Kinji Takase, Hamamatsu (JP)

(73) Assignee: Hamamatsu Photonics K.K., Shizuoka (JP)

( * ) Notice: Subject to any disclaimer, the term of this patent is extended or adjusted under 35 U.S.C. 154(b) by 0 days.

(21) Appl. No.: 10/132,736

(22) Filed: Apr. 26, 2002

(65) Prior Publication Data

US 2002/0168050 A1 Nov. 14, 2002

Related U.S. Application Data

(63) Continuation-in-part of application No. PCT/JP00/07559, filed on Oct. 27, 2000.

(30) Foreign Application Priority Data

Oct. 29, 1999 (JP) ..... P11-309846

(51) Int. Cl.[7] ..... H01J 35/00

(52) U.S. Cl. ..... 378/119; 378/101; 439/606; 439/276; 439/936

(58) Field of Search ..... 378/101, 119; 439/606, 276, 936

(56) References Cited

U.S. PATENT DOCUMENTS 3,643,094 A * 2/1972 Courtois ..... 378/196
5,517,545 A 5/1996 Nakamura et al. ..... 378/101
5,857,008 A 1/1999 Reinhold ..... 378/137
6,556,654 B1 * 4/2003 Hansen et al. ..... 378/101

FOREIGN PATENT DOCUMENTS

| | | | |
|---|---|---|---|
| JP | 58-14499 | | 1/1983 |
| JP | 6-188092 | | 7/1994 |
| JP | 8-162285 | | 6/1996 |
| JP | 10-39037 | | 2/1998 |
| JP | 10-39097 | | 2/1998 |
| JP | 10-503618 | | 3/1998 |
| JP | 2001-124899 | * | 5/2001 |
| WO | WO 96/29723 | | 9/1996 |

* cited by examiner

*Primary Examiner*—Drew A. Dunn
(74) *Attorney, Agent, or Firm*—Morgan, Lewis & Bockius LLP

(57) ABSTRACT

For eliminating a high-tension cable in order to improve the handling, the open type X-ray generating apparatus (1) in accordance with the present invention employs a mold power unit in which a high-voltage generating part, a grid connecting line, and a filament connecting line which attain a high voltage are molded with a resin, whereas the mold power unit is secured to the proximal end side of a tubular portion (2), whereby an apparatus of a type integrated with a power supply is realized. Since the high-voltage generating part, grid connecting line, and filament connecting line are confined within the resin mold as such, the degree of freedom in structure of the high-voltage generating part and the degree of freedom in bending the lines improve remarkably.

7 Claims, 7 Drawing Sheets

OPEN TYPE X-RAY GENERATING APPARATUS

RELATED APPLICATION

This is a continuation-in-part application of application Ser. No. PCT/JP00/07559 filed on Oct. 27, 2000, now pending.

BACKGROUND OF THE INVENTION

1. Field of the Invention

The present invention relates to an open type X-ray generating apparatus; and, in particular, to an open type X-ray apparatus making it possible to replace a filament part, which is a consumable, by utilizing vacuum aspiration effected by a pump.

2. Related Background Art

Conventionally known as a technique in such a field is Japanese Patent Application Laid-Open No. HEI 10-503618. In the X-ray generating apparatus disclosed in the above-mentioned publication, electron beams emitted from a cathode are focused onto a target by an electromagnetic action of a coil, whereby an X-ray beam is emitted from a target toward an object to be inspected. Here, since the X-ray generating apparatus operates at a very high voltage of 160 kV, it has a separate, large-size, high-voltage power unit which is connected to the X-ray generating apparatus by a high-tension cable.

Since the high-voltage power unit for driving the X-ray generating apparatus has a structure for generating a very high voltage of 100 kV to 300 kV, however, the high-tension cable for transmitting this voltage to the X-ray generating apparatus must become very thick (e.g., a diameter of 40 mm) and heavy. The handling of such a high-tension cable is required to be managed quite strictly. Namely, the degree of freedom in bending this high-tension cable is very low because of its high-tension characteristics and structure, whereby extreme caution must be taken to prevent disasters from occurring due to electric leakage upon connection to the X-ray generating apparatus, and periodical maintenance is necessary for preventing electric leakage from occurring from a connecting part, thus putting an excessive load on operators and users. In addition, the weight of high-tension cable has been a factor further enhancing the burden of operators.

While Japanese Patent Application Laid-Open No. SHO 58-14499 discloses an X-ray generating apparatus having a high-voltage power unit molded with epoxy resin, this X-ray generating apparatus is of a sealed type, which differs from apparatus of a type making it possible to replace a filament by arbitrarily producing a vacuum by utilizing a pump. Also, as measures against discharge at connecting parts from the mold portion to the grid, a bushing made of synthetic rubber is attached thereto. Further, power is supplied to the filament separately from the outside.

SUMMARY OF THE INVENTION

For overcoming the problem mentioned above, it is an object of the present invention, in particular, to provide an open type X-ray generating apparatus of a type making its filament part replaceable, whose handling is improved.

The open type X-ray generating apparatus in accordance with the present invention comprises a tubular portion having an electron path, the inside of said tubular portion being vacuumed by a pump; a mold power unit secured to a proximal end side of said tubular portion, the mold power unit having a high-voltage generating part and connecting lines electrically connected to the high-voltage generating part which are enclosed with a electrical insulating mold therein; a target provided in said tubular portion; an electron gun mounted to the mold power unit so as to electrically connect the connecting lines of the mold power unit and opposed to said target with the electron path interposed therebetween.

It is further object of the present invention to provide an open type X-ray generating apparatus comprising; a tubular portion, adapted to be vacuumed by a pump, having a coil part therewithin and an electron path surrounded by the coil part; a target provided in; a mold power unit, secured to a proximal end side of said tubular portion, having a high-voltage generating part and grid and filament connecting lines electrically connected to said high-voltage generating part which are enclosed within a resin mold; and an electron gun having a replaceable filament part electrically connected thereto by way of the filament connecting line and a grid part, electrically connected to the grid connecting line, surrounding the filament part, the electron gun being attached to the mold power unit so as to oppose the target with the electron path interposed therebetween.

This open type X-ray generating apparatus utilizes vacuum aspiration effected by the pump, so as to make it possible to replace the filament part, which is a consumable, thereby improving the maintenance. Such an apparatus is required to have not only durability but also easiness in handling. Hence, for eliminating the high-tension cable in order to improve the handling, a mold power unit in which a high-voltage generating part, a grid connecting line, and a filament line which attain a high voltage (e.g., 160 kV) are molded with a resin is employed, whereas this mold power unit is secured to the proximal end side of the tubular portion, whereby an apparatus of a type integrated with a power supply is realized. Since the high-voltage generating part, grid connecting line, and filament connecting line are confined within the resin mold as such, the degree of freedom in configuration of the high-voltage generating portion and the degree of freedom in bending lines within the mold improve remarkably. Also, since the conventional necessity for the high-tension cable is eliminated, the mold power unit can further reduce its size, whereby the apparatus itself can be made smaller, which remarkably improves the handling of apparatus together with the fact that the high-voltage portion as a whole is enclosed within a resin.

DETAILED DESCRIPTION OF THE PREFERRED EMBODIMENTS

In the following, a preferred embodiment of the open type X-ray generating apparatus in accordance with the present invention will be explained in detail with reference to the drawings.

Figure 1:
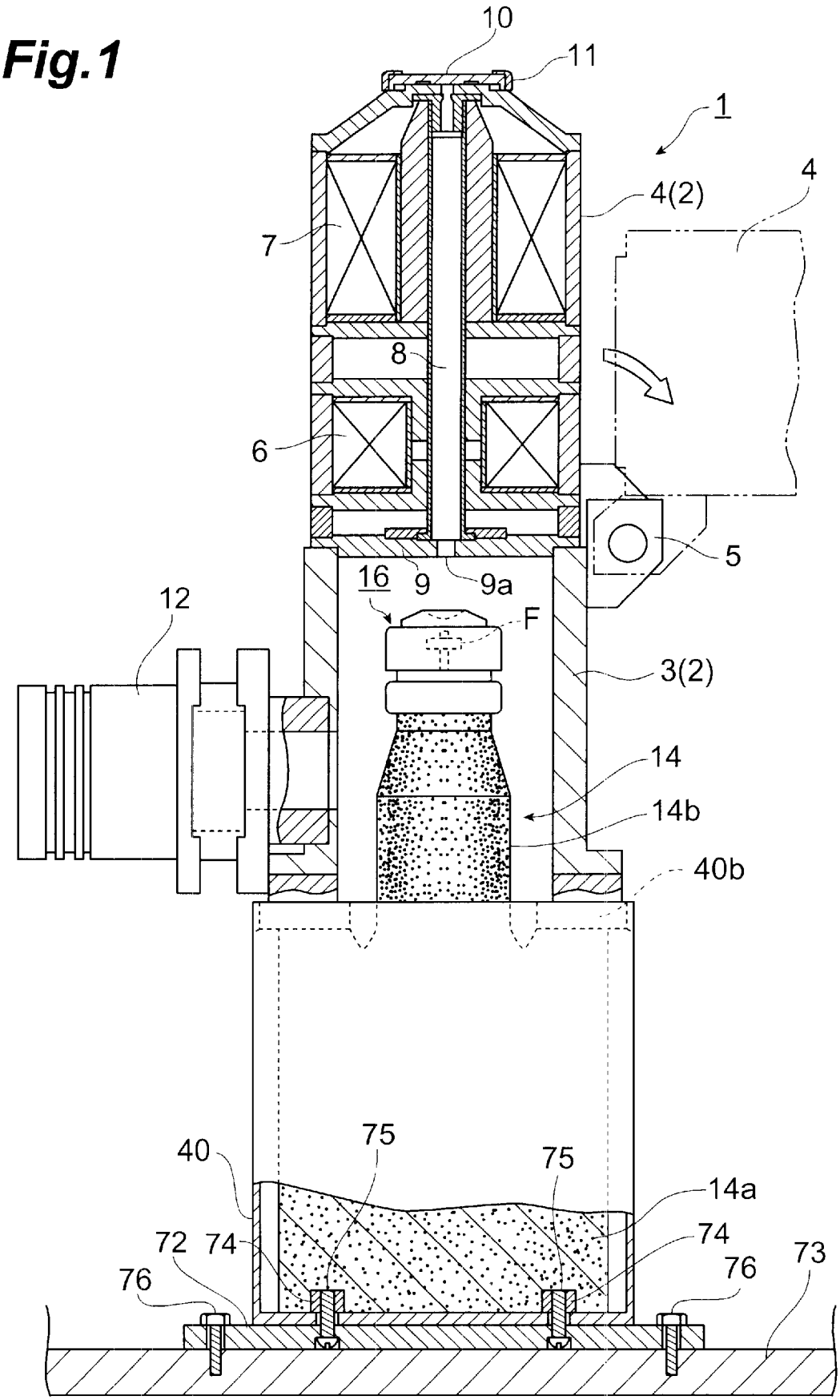
FIG. 1 is a sectional view showing an embodiment of the open type X-ray generating apparatus in accordance with the present invention.

As shown in FIG. 1, this X-ray generating apparatus 1 is of an open type and can arbitrarily produce a vacuum state unlike closed types which are disposable, thereby making it possible to replace a filament part F and a target 10 which are consumables. This X-ray generating apparatus 1 has a tubular portion 2 made of stainless steel with a cylindrical form, which attains a vacuum state upon operation. The tubular portion 2 is divided into two parts, i.e., a fixed part 3 and a detachable part 4 which are located on the lower and upper sides, respectively, whereas the detachable part 4 is attached to the fixed part 3 by way of a hinge part 5. Therefore, when the detachable part 4 pivots by way of the hinge part 5 so as to topple sideways, the upper portion of the fixed part 3 can be opened, so as to allow access to the filament part (cathode) F accommodated in the fixed part 3.

Within the detachable part 4, a pair of upper and lower tubular coil parts 6, 7 functioning as an electromagnetic deflection lens are provided, whereas an electron path 8 extends in the longitudinal direction of the tubular portion 2 so as to pass through the centers of the coil parts 6, 7 and is surrounded by the coil parts 6, 7. A disk plate 9 is secured to the lower end of the detachable part 4 so as to close the same, where as an electron inlet hole 9*a* aligning with the electron path 8 on its lower end side is formed at the center of the disk plate 9.

The upper end of the detachable part 4 is formed into a truncated cone having a top portion to which a disk-shaped target 10, positioned on the upper end side of the electron path 8, for forming an electron transmission type X-ray emission window is attached. The target 10 is made of a member by which an electron generated from the filament F and transmitted through the electron passage 8 is converted into an X-ray, and is accommodated in a detachable rotary cap part 11 while in a state grounded thereto. Therefore, the target 10, which is a consumable, can also be replaced upon removing the cap part 11.

On the other hand, a vacuum pump 12 is secured to the fixed part 3, and is used for attaining a highly vacuum state within the whole tubular portion 2. Namely, since the X-ray generating apparatus 1 is equipped with the vacuum pump 12, the filament part F and target 10, which are consumables, can be replaced.

Here, a mold power unit 14 integrated with an electron gun 16 is secured to the proximal end side of the tubular portion 2. The mold power unit 14 is one molded with an electrically insulating resin (e.g., epoxy resin), and is accommodated within a case 40 made of a metal. The lower end (proximal end) of the fixed part 3 of the tubular portion 2 is firmly secured to an upper plate 40*b* of the case 40 by screwing or the like in a sealed state.

Figure 2:
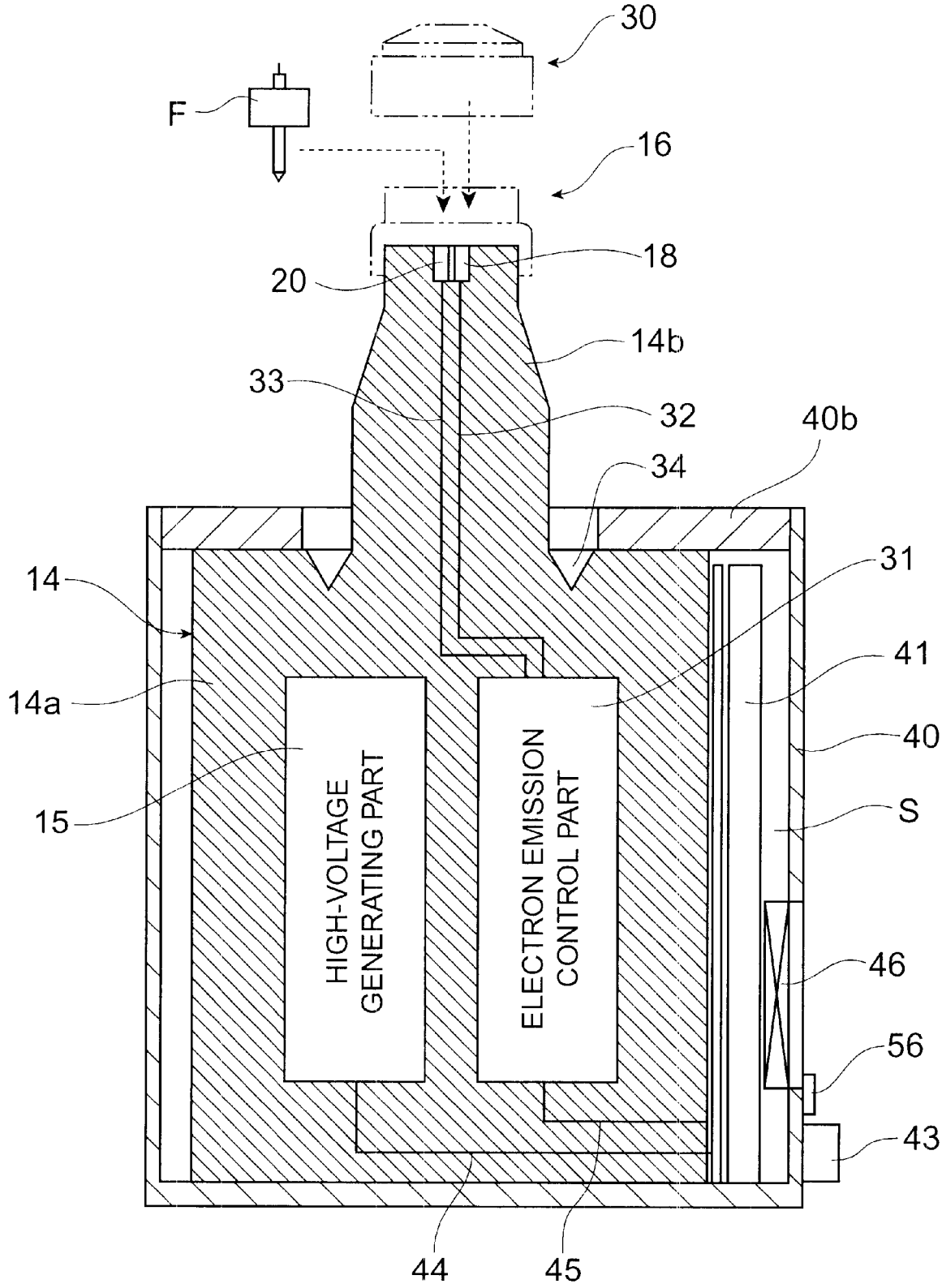
FIG. 2 is a sectional view showing a mold power unit of the X-ray generating apparatus shown in FIG. 1.

As shown in FIG. 2, a high-voltage generating part 15 constituting a transformer generating a high voltage (e.g., a maximum of −160 kV when grounding the target 10) is enclosed within the mold power unit 14. Specifically, the mold power unit 14 comprises a block-shaped power unit body 14*a*, positioned on the lower side, having a rectangular parallelepiped form; and a columnar neck part 14*b* projecting upward into the fixed part 3 from the power unit body 14*a*. Since the high-voltage generating part 15 is a heavy component, it is preferably enclosed within the power unit body 14*a*, and arranged as low as possible in view of the weight balance of the whole apparatus 1.

Figure 3:
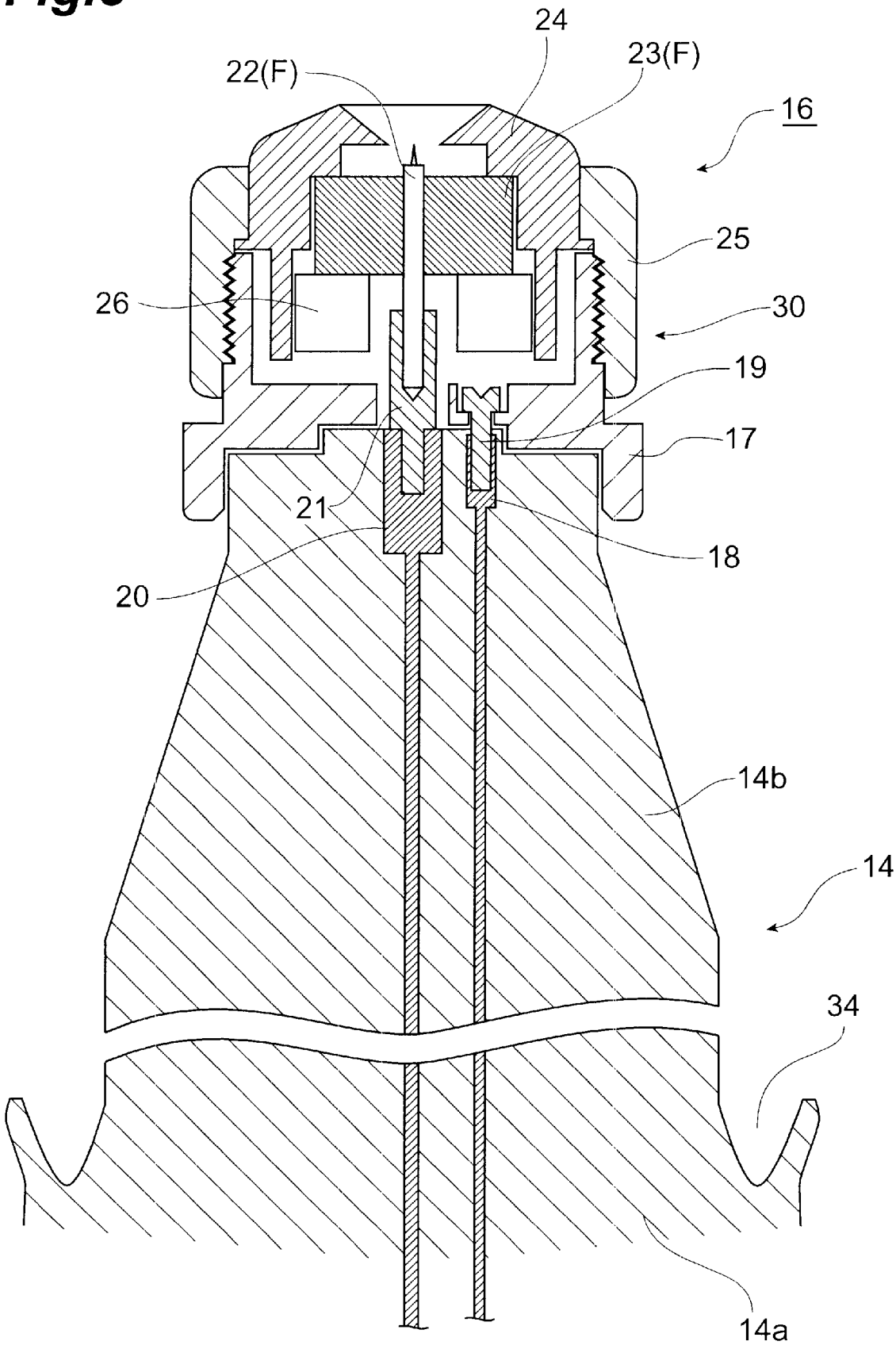
FIG. 3 is a sectional view showing an electron gun of the X-ray generating apparatus shown in FIG. 1.

Attached to the leading end portion of the neck part 14*b* is the electron gun 16 arranged so as to oppose the target 10 with the electron path 8 interposed therebetween. As shown in FIG. 3, the electron gun 16 has a grid base 17 to be attached to the neck part 14*b*, whereas the grid base 17 is fixed, by means of a thread part 19, with respect to a grid terminal 18 embedded in the leading end face of the neck part 14*b*.

Also, a filament terminal 20 is embedded in the neck part 14*b* at the leading end face thereof. A heater socket 21 is screwed into the terminal 20, whereas the filament part F is detachably attached to the leading end of the heater 25 socket 21. Here, the filament part F is constituted by a heater pin 22 to be inserted into the heater socket 21 and a heater base 23 for supporting the heater pin 22, whereas the heater pin 22 is freely detachable from the heater socket 21.

Further, the filament part F is covered with a grid cap 24 so as to form a lid, and a grid securing ring 25 is screwed onto the grid base 17, so as to press the grid cap 24 from thereabove. As a result, the heater base 23 of the filament part F accommodated within the grid cap 24 is secured in cooperation with a press ring 26. Thus, the filament part F is configured so as to be replaceable when necessary.

In thus configured electron gun 16, the grid base 17 electrically connected to the grid terminal 18, the grid securing ring 25, and the grid cap 24 constitute a grid part 30. On the other hand, the filament part F electrically connected to the filament terminal 20 by way of the heater socket 21 constitutes a cathode electrode.

Within the power unit body 14*a* of the mold power unit 14, as shown in FIG. 2, an electron emission control part 31 electrically connected to the high-voltage generating part 15 is enclosed, and controls electron emission timings, tube current, and the like. The electron emission control part 31 is connected to the grid terminal 18 and filament terminal 20 by way of a grid connecting line 32 and a filament connecting line 33, respectively, whereas the connecting lines 32, 33 are enclosed in the neck part 14*b* since a high voltage is applied to both of them.

Namely, not only the high-voltage generating part 15 but also the grid connecting line 32 feeding electricity to the grid part 30 and the filament connecting line 33 feeding electricity to the filament part F attain a high voltage. Specifically, when the target 10 is grounded, a maximum voltage of −160 kV can be produced in the high-voltage generating part 15. At that time, in a state floated to a high voltage (−160 kV), a voltage of—several hundred V is applied to the grid connecting line 32, whereas a voltage of −2 to −3 V is applied to the filament connecting line 33.

Therefore, when each of such feeder components attaining a high voltage is confined within the electrically insulating resin mold, the degree of freedom in configuration of the high-voltage generating part 15 and the degree of freedom in bending of the lines 32, 33 can be improved remarkably, so as to help the mold power unit 14 reduce its size, thereby making the apparatus itself smaller, which remarkably improves the handling of the apparatus 1.

Further, as shown in FIGS. 1 to 3, the power unit body 14*a* is provided with a groove part 34 surrounding the base portion of the neck part 14*b* in an annular fashion. The groove part 34 enhances the creepage distance between the grid base 17 and the case 40, whereby creepage discharge can effectively be prevented from occurring in the surface of the mold power unit 14. On the other hand, the neck part 14*b* extending from the power unit body 14*a* into the tubular portion 2 can enhance the creepage distance from the mold power unit 14, whereby creepage discharge can appropriately be prevented from occurring in the surface of the mold power unit 14 when the mold power unit 14 is in a vacuum state.

Figure 4:
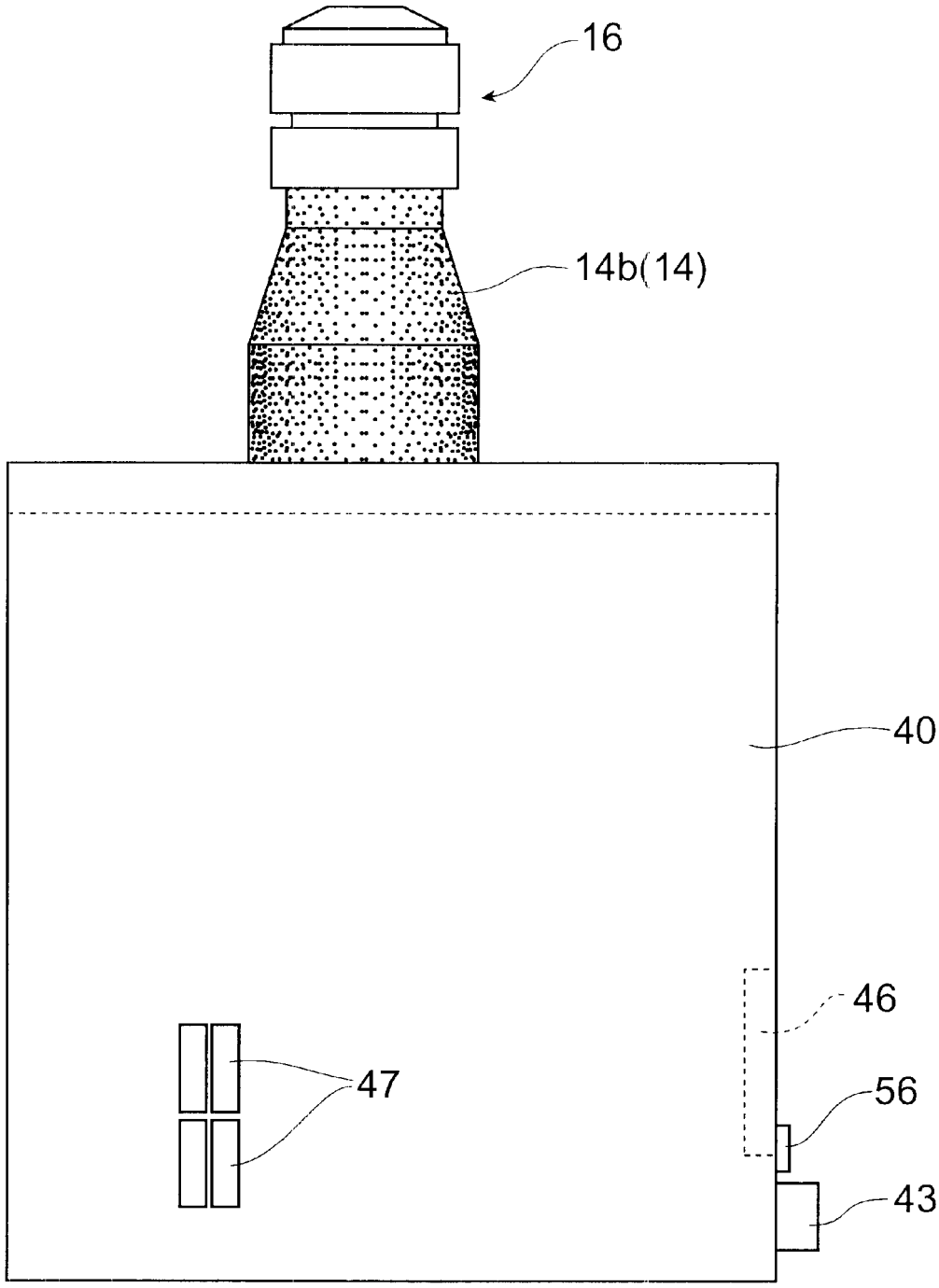
FIG. 4 is a side view showing the appearance of the mold power unit shown in FIG. 2.

Here, as shown in FIGS. 2 and 4, the power unit body 14*a* is accommodated in the case 40 made of a metal, whereas a space S is provided between the power unit body 14*a* and the case 40, so that a high-voltage control part 41 is arranged within the space S. A power terminal 43 for connecting with an external power supply is secured to the case 40, whereas the high-voltage control part 41 is connected not only to the power terminal 43, but also to the high-voltage generating part 15 and electron emission control part 31 within the mold power unit 14 by way of lines 44, 45, respectively. Also, according to a control signal from the outside, the high-voltage control part 41 controls a voltage which can be generated in the high-voltage generating part 15 constituting the transformer, such that it ranges from a high voltage (e.g., 160 kV) to a low voltage (0 V). Further, the electron emission control part 31 controls electron emission timings, tube current, and the like. Since the high-voltage control part 41 is disposed in close proximity to the mold power unit 14 whereas the high-voltage control part 41 is stored within the case 40 as such, the handling of the apparatus 1 improves remarkably.

Various electronic components are implemented in such a high-voltage control part 41. Therefore, it is important for each component to be cooled in order to stabilize its operating characteristics. Hence, a cooling fan 46 is attached to the case 40, so that air flows within the space S, whereby the high-voltage control part 41 is forcibly cooled.

Figure 5:
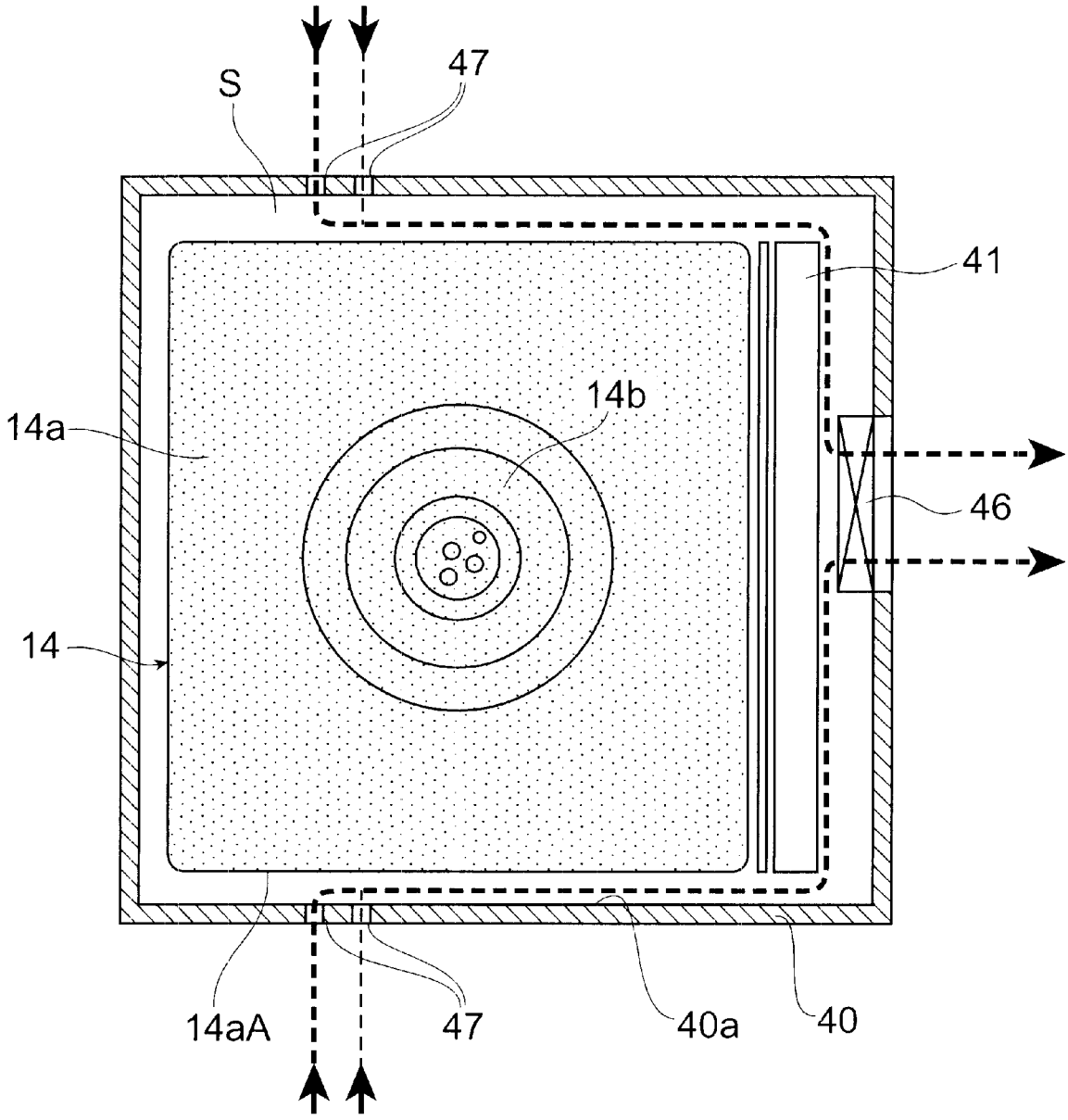
FIG. 5 is a sectional view of a case of the mold power unit shown in FIG. 4.

Further, as shown in FIG. 5, the space S is formed by an inner peripheral face 40*a* of the case 40 and an outer wall face 14*a*A of the power unit body 14*a* so as to surround the outer periphery of the power unit body 14*a*. A side face of the case 40 is formed with a pair of left and right intake ports 47. As a consequence, the intake ports 47 and the cooling fan 46 cooperate, thereby making it possible to cool not only the high-voltage control part 41, but also the surface of the mold power unit 14. This can stabilize operating characteristics of various components molded within the mold power unit 14, thereby elongating the life of the mold power unit 14. Alternatively, exhaust ports may be referred to with numeral 47, so as to introduce air by use of the cooling fan 46.

Figure 6:
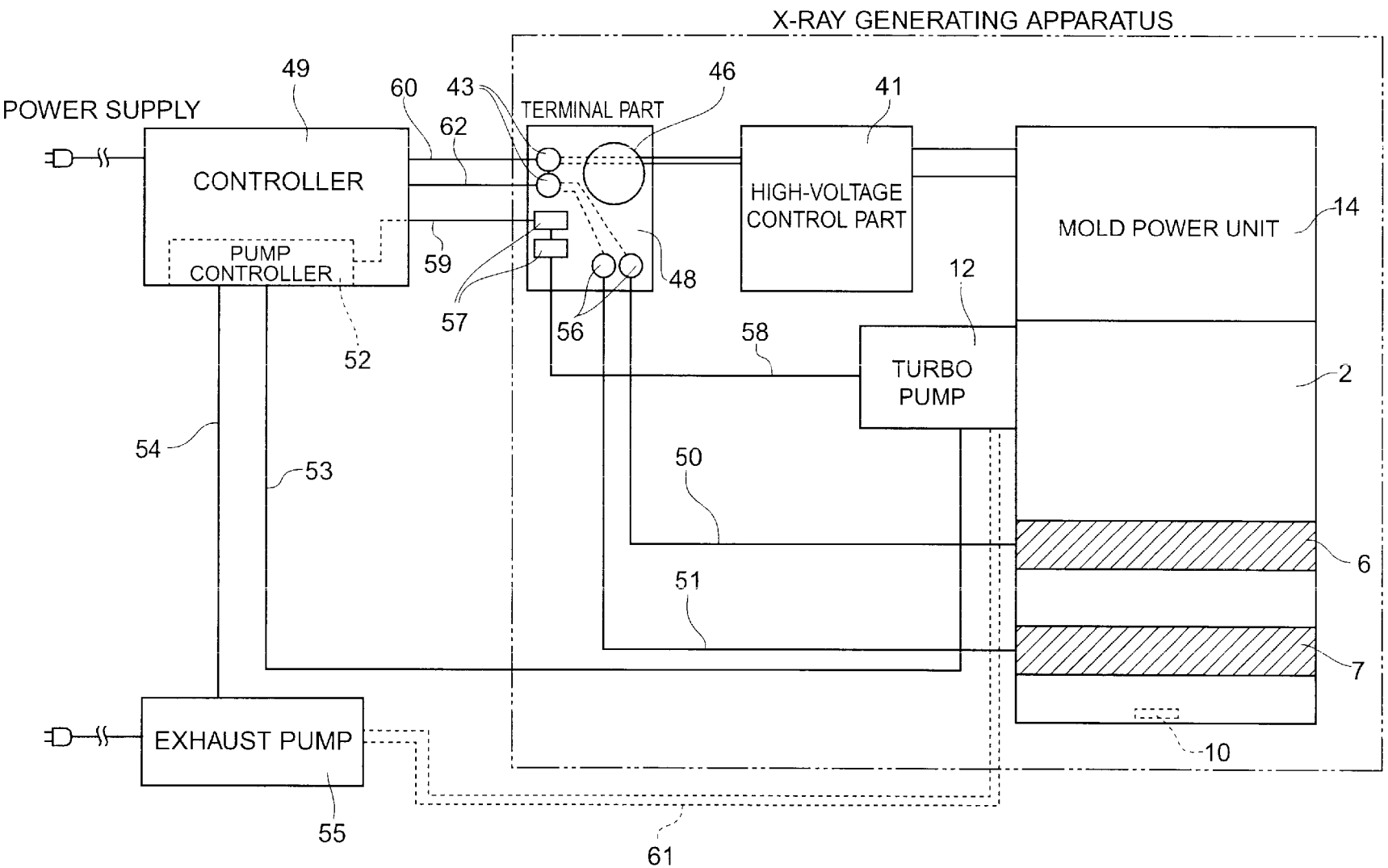
FIG. 6 is a block diagram showing a driving control portion of the X-ray generating apparatus in accordance with the present invention.

In the X-ray generating apparatus 1, as shown in FIG. 6, a terminal part 48 is secured to the case 40. Provided in the terminal part 48 are power terminals 43 to which a controller 49 for connecting with the external power supply is connected by way of detachable lines 60, 62. Here, one terminal 43 is connected to the high-voltage control part 41, whereas the other terminal 43 is connected to coil terminals 56. When such terminals 43 are utilized, the X-ray generating apparatus 1 is appropriately fed with electricity. The terminal part 48 is further provided with the coil terminals 56, to which two detachable coil control lines 50, 51 are connected, respectively, whereas the coil control lines 50, 51 are connected to the coil parts 6, 7, respectively. As a consequence, the feeding of electricity to each of the coil parts 6, 7 is controlled individually.

Therefore, according to the control effected by the controller 49, a power and a control signal are supplied to the high-voltage generating part 15 and electron emission control part 31 of the mold power unit 14, respectively, from the high-voltage control part 41 within the case 40 by way of one terminal 43. Simultaneously therewith, the coil parts 6, 7 are also fed with electricity by way of the lines 50, 51 connected to the other terminal 43. As a result, electrons are emitted from the filament part F with an appropriate acceleration, and are appropriately converged by the controlled coil parts 6, 7, so as to bombard the target 10, whereby X-rays are emitted to the outside.

A pump controller 52 to be utilized when replacing the filament part F and target 10 controls the turbo pump 12 and an exhaust pump 55 by way of lines 53, 54, respectively. Further, the turbo pump 12 and the exhaust pump 55 are connected to each other by way of a pipe 61. Such a configuration of two-stage pump can achieve a high degree of vacuum within the tubular portion 2.

By way of a detachable line 58, a vacuum measuring signal from the turbo pump 12 is fed to one pump terminal 57 of the terminal part 48. By contrast, the other pump terminal 57 is connected to the controller 49 by way of a detachable line 59. As a consequence, the degree of vacuum in the tubular portion 2 is appropriately managed by the controller 49 by way of the lines 58 and 59.

A nondestructive inspection apparatus 70 will now be explained as an example in which the above-mentioned open type X-ray generating apparatus 1 is utilized.

Figure 7:
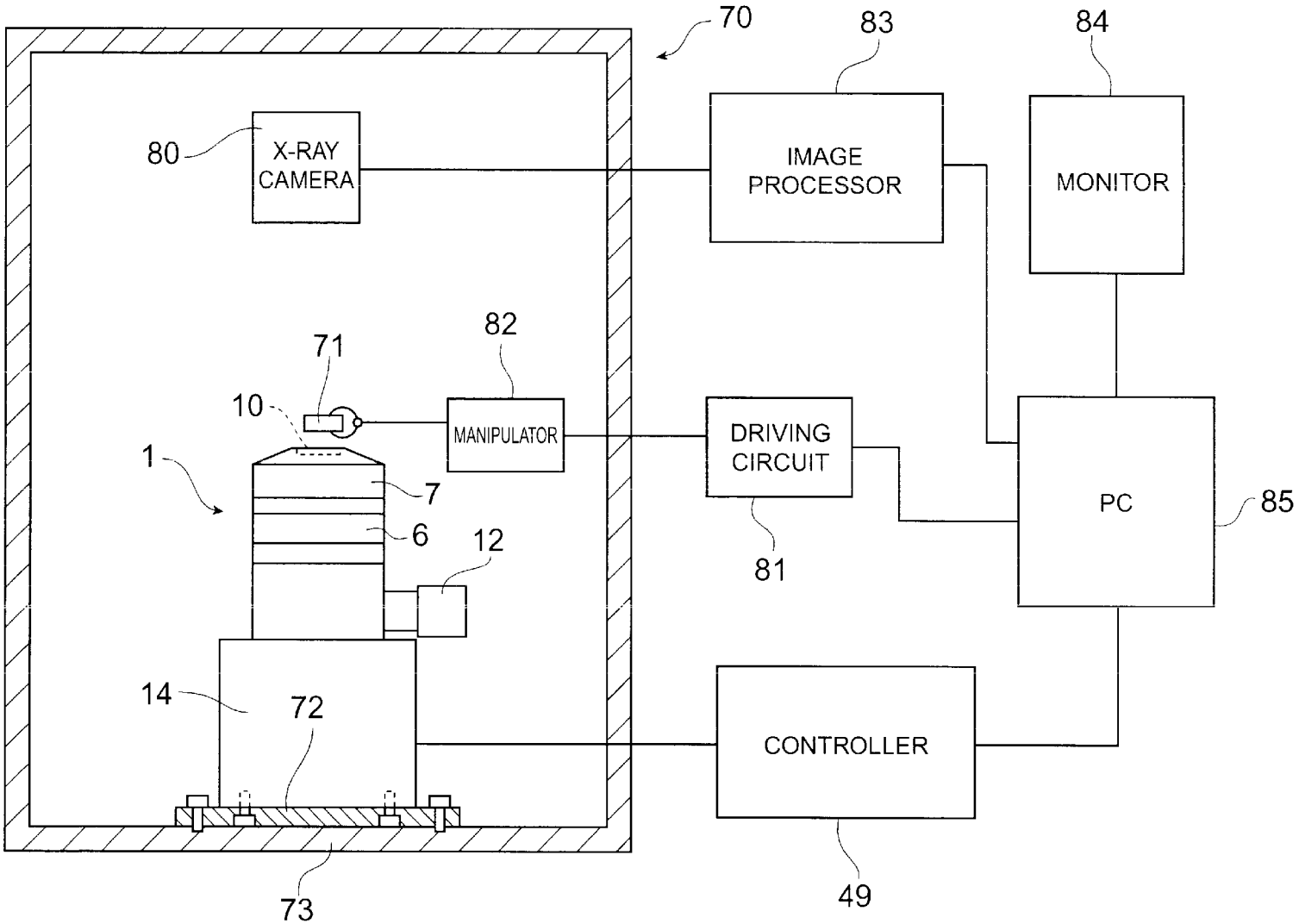
FIG. 7 is a schematic view showing a nondestructive inspection apparatus employing the X-ray generating apparatus in accordance with the present invention.

As shown in FIG. 7, the nondestructive inspection apparatus 70 is utilized for inspecting whether a junction part of a lead or the like in an electronic component implemented in a circuit board (object to be inspected) 71 is good or not. The X-ray generating apparatus 1 is installed so as to be secured to the lower part of the nondestructive inspection apparatus 70 while in a state where the target 10 and the heavy mold power unit 14 are located on the upper and lower sides, respectively. Such installation is an arrangement taking the weight balance of the X-ray generating apparatus 1 into consideration, which makes it possible to stably place the X-ray generating apparatus 1, which is hard to topple over. Since the center of gravity of the X-ray generating apparatus 1 is located on the lower side, the X-ray generating apparatus 1 can be maintained in a stable state (see FIG. 1) even in the case where the detachable part 4 is pivoted by way of the hinge part 5 so as to topple sideways when replacing the filament part F.

Also, as can be seen from the configuration mentioned above, the X-ray generating apparatus 1 does not require a high-tension cable which is thick and has a very low degree of freedom in bending. As a result, the X-ray generating apparatus 1 is not required to be placed in the nondestructive inspection apparatus 70 in a suspended state, and can be placed so as to be mounted on the base plate 73, whereby the degree of freedom in its placement can be considered very high.

Further, the X-ray generating apparatus 1 is secured to the base plate 73 of the nondestructive inspection apparatus 70 by way of a vibration absorbing plate 72 made of a rubber material or the like. When the vibration absorbing plate 72 is employed, the X-ray generating apparatus 1 can appropriately be utilized as a microfocus X-ray source.

Specifically, female threads 74 are integrally embedded in the lower face of the power unit body 14*a* in the mold power unit 14 upon molding as shown in FIG. 1. The female threads 74 and male threads 75 cooperate, so as to secure the vibration absorbing plate 72 to the bottom face of the case 40. Also, the vibration absorbing plate 72 is secured to the base plate 73 of the nondestructive inspection apparatus 70 by installation screws 76. Thus, the X-ray generating apparatus 1 having no high-tension cable can be installed with simple fastening means such as threads alone, which greatly contributes to improving the workability.

In the nondestructive inspection apparatus 70 having thus installed X-ray generating apparatus 1, as shown in FIG. 7, an X-ray camera 80 is placed directly thereabove so as to oppose the target 10, whereby X-rays transmitted through the circuit board 71 are captured by the X-ray camera 80. The circuit board 71 is tilted with an appropriate angle by a manipulator 82 controlled by a driving circuit 81.

Therefore, when the circuit board 71 is swung appropriately, the state of junction of lead parts in electronic components can be observed three-dimensionally. On the other hand, images captured by the X-ray camera 80 are sent to an image processor 83, so as to be displayed on a screen by a monitor 84. The controller 49, driving circuit 81, image processor 83, and monitor 84 are managed by an I/O-capable PC 85.

The above-mentioned embodiment will be summarized as follows:

Preferably, the above-mentioned mold power unit has a block-shaped power unit body, and a neck part projecting from the power unit body into the tubular portion and enclosing the grid connecting line and filament connecting line therewithin, whereas the electron gun is attached to a leading end portion of the neck part. When such a configuration is employed, the creepage distance of the mold power unit can be enhanced by the neck part extending from the power unit body, whereby creepage discharge can appropriately be prevented from occurring in the surface of the mold power unit even when the mold power unit is in a vacuum state.

Preferably, the power unit body is provided with a groove part surrounding the base portion of the neck part. When such a configuration is employed, the groove part enhances the creepage distance of the mold power unit and appropriately prevents the surface of the neck part and the surface of the power unit body from electrically connecting with each other, where by creepage discharge can appropriately be prevented from occurring in the surface of the mold power unit.

Preferably, the tubular portion comprises a fixed part having a proximal end side secured to the power unit and accommodating the neck part of the mold power unit; and a detachable part, attached to a leading end side of the fixed part, having therewithin the coil part and the electron path. When such a configuration is employed, the tubular portion can be divided into two, whereby an operation for replacing the filament part accommodated on the fixed part side becomes easy by employing the detachable part.

The present invention relates to an open type X-ray generating apparatus making it possible to replace a filament part, which is a consumable, by utilizing vacuum aspiration effected by a pump, and is of a type making the filament part replaceable, whose handling is improved.

What is claimed is:

1. An open type X-ray generating apparatus comprising;

a tubular portion having an electron path, the inside of said tubular portion being vacuumed by a pump;

a mold power unit secured to a proximal end side of said tubular portion, said mold power unit having a high-voltage generating part and connecting lines electrically connected to said high-voltage generating part which are enclosed with an electrical insulating mold therein;

a target provided in said tubular portion;

an electron gun mounted to said mold power unit so as to electrically connect said connecting lines of said mold power unit and opposed to said target with said electron path interposed therebetween.

2. An open type X-ray generating apparatus comprising;

a tubular portion, adapted to be vacuumed by a pump, having a coil part therewithin and an electron path surrounded by said coil part;

a target provided in said tubular;

a mold power unit, secured to a proximal end side of said tubular portion, having a high-voltage generating part and grid and filament connecting lines electrically connected to said high-voltage generating part which are enclosed within a resin mold; and an electron gun having a replaceable filament part electrically connected thereto by way of said filament connecting line and a grid part, electrically connected to said grid connecting line, surrounding said filament part, said electron gun being attached to said mold power unit so as to oppose said target with said electron path interposed therebetween.

3. An open type X-ray generating apparatus according to claim 2, wherein said mold power unit has a block-shaped power unit body, and a neck part projecting from said power unit body into said tubular portion and enclosing said grid and filament connecting lines therewithin, said electron gun being attached to a leading end portion of said neck part.

4. An open type X-ray generating apparatus according to claim 2, wherein said power unit body is provided with a groove part surrounding a base portion of said neck part.

5. An open type X-ray generating apparatus according to claim 3, wherein said power unit body is provided with a groove part surrounding a base portion of said neck part.

6. An open type X-ray generating apparatus according to claim 3, wherein said tubular portion comprises a fixed part having a proximal end side secured to said power unit and accommodating said neck part of said mold power unit; and a detachable part, attached to a leading end side of said fixed part, having therewithin said coil part and said electron path.

7. An open type X-ray generating apparatus according to claim 5, wherein said tubular portion comprises a fixed part having a proximal end side secured to said power unit and accommodating said neck part of said mold power unit; and a detachable part, attached to a leading end side of said fixed part, having therewithin said coil part and said electron path.

* * * * *